US005902178A

United States Patent [19]

Perkitny

[11] Patent Number: 5,902,178

[45] Date of Patent: May 11, 1999

[54] COIN SORTING APPARATUS

[75] Inventor: Jerzy Perkitny, Bay Village, Ohio

[73] Assignee: Mag-Nif Incorporated, Mentor, Ohio

[21] Appl. No.: 08/799,774

[22] Filed: Feb. 12, 1997

Related U.S. Application Data

[63] Continuation-in-part of application No. 29/052,269, Mar. 27, 1996, Pat. No. Des. 393,531.

[51] Int. Cl.[6] ..... G07D 3/04

[52] U.S. Cl. ..... 453/9; 453/61

[58] Field of Search ..... 453/5, 7, 9, 11, 453/12, 13, 14, 15, 16, 17, 61, 62, 63, 34

[56] References Cited

U.S. PATENT DOCUMENTS

| | | | |
|---|---|---|---|
| D. 270,868 | 10/1983 | Spirk, Jr. et al. . | |
| D. 283,075 | 3/1986 | Spirk, Jr. et al. . | |
| D. 288,499 | 2/1987 | Wan . | |
| D. 296,029 | 5/1988 | Knox . | |
| 1,823,829 | 9/1931 | Jones et al. | 453/15 |
| 1,902,328 | 3/1933 | Howenstine | 453/34 |
| 2,348,936 | 5/1944 | Sprenger | 453/34 X |
| 2,423,502 | 7/1947 | Jorgensen . | |
| 3,161,351 | 12/1964 | Lerner . | |
| 3,242,931 | 3/1966 | Wandrey . | |
| 3,313,477 | 4/1967 | Brown . | |
| 3,338,250 | 8/1967 | Mehelich . | |
| 3,410,385 | 11/1968 | Freet et la. . | |
| 4,304,247 | 12/1981 | Hasegawa . | |
| 4,374,529 | 2/1983 | Kobayashi et al. | 453/17 |
| 4,479,502 | 10/1984 | Iversen . | |
| 4,511,341 | 4/1985 | Spirk, Jr. et al. . | |
| 4,987,990 | 1/1991 | Perkitny | 194/242 |
| 4,995,848 | 2/1991 | Goh . | |
| 5,122,093 | 6/1992 | Perkitny | 453/13 |
| 5,232,399 | 8/1993 | Le Hong et al. | 453/57 |
| 5,443,419 | 8/1995 | Adams et al. | 453/17 |
| 5,474,496 | 12/1995 | Perkitny | 453/9 |

FOREIGN PATENT DOCUMENTS

| | | | |
|---|---|---|---|
| 6-150103 | 5/1994 | Japan | 453/9 |
| 412052 | 7/1933 | United Kingdom . | |
| 2 130 779 | 10/1983 | United Kingdom . | |

OTHER PUBLICATIONS

MAGNIF, 1994, Brochure (9 sheets).

*Primary Examiner*—F. J. Bartuska
*Attorney, Agent, or Firm*—Fay, Sharpe, Beall, Fagan, Minnich & McKee

[57] ABSTRACT

A coin sorting apparatus includes a coin hopper (24) having a coin exit aperture (30) and a ramp (32) located adjacent thereto. The ramp (32) includes an upper end (34) and slopes downward to a lower end (36). A plurality of apertures (38*a*–38*d*) are formed through the ramp (32). The apertures (38*a*–38*d*) are sized and arranged such that coins of differing diameters sliding down the ramp (32) pass through one of the apertures (38*a*–38*d*). A coin container assembly (50) located below the ramp (32) includes first and second sets (54,56) of coin containers (52). Each set (54,56) includes a plurality of coin containers (54*a*–*d*,56*a*–d), respectively. The containers (56*a*–*d*) of the second set (56) are positioned adjacent the containers (54*a*–*d*) of the first set (54). When one of the containers (54*a*–*d*) of the first set (54) is filled with coins, additional coins slide into a corresponding container (56*a*–*d*) of the second set (56). A coin separator mechanism (90) dispenses coins from the coin hopper (24) onto the ramp (32). The container assembly (50) moves between an operative position for receiving coins and a container removal position. A safety switch (110) selectively disables the coin separator mechanism (90) when the container assembly (50) is moved out of its operative position. A cam and follower mechanism including a cam (70) and a follower (84) pivots the container assembly (50) between the operative and the container removal positions. The cam (70) includes two dwell points (80,82) for releasably securing the follower (84).

26 Claims, 8 Drawing Sheets

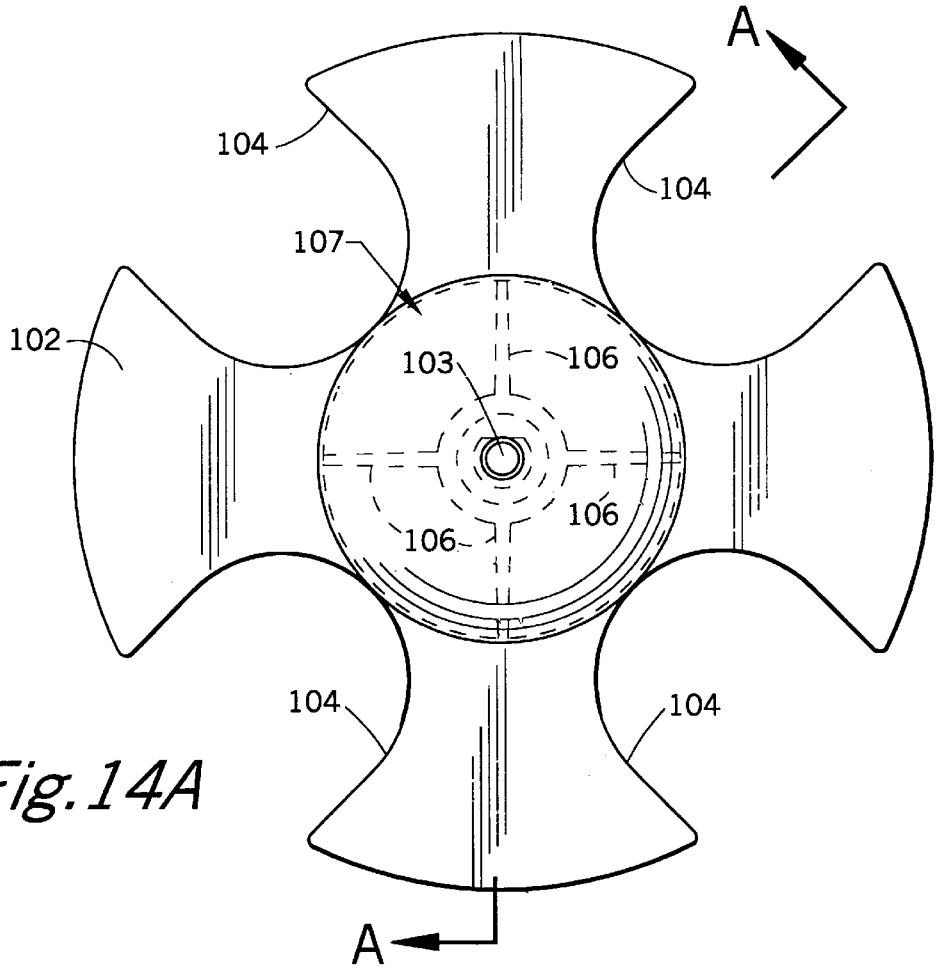
Fig. 14A
Fig. 14B
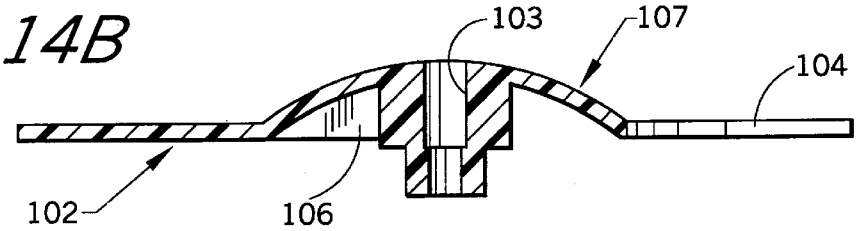
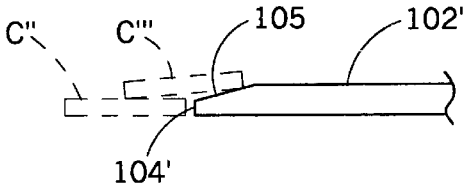
Fig. 14C
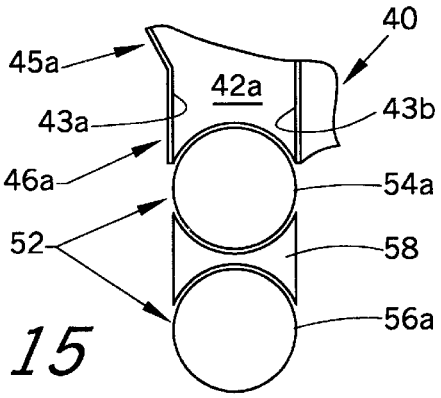
Fig. 15

COIN SORTING APPARATUS

This application is a continuation-in-part of U.S. Design patent application Ser. No. 29/052,269 which was filed on Mar. 27, 1996 now U.S. Pat. No. D 393,531.

BACKGROUND OF THE INVENTION

The present invention relates to a coin sorting apparatus. More particularly, the present invention relates to an easy to use coin sorting apparatus with increased sorted coin storage. The apparatus includes a pivotable coin container assembly that is releasably secured in either an operative position or a container removal position. A safety switch is included to prevent the activation of the coin separating mechanism when the coin container assembly is not operatively positioned to receive sorted coins.

Coin sorting devices are generally known. A user places one or more coins in a hopper or similar coin receiving location. A coin separating mechanism separates the coins and dispenses them one at a time from the hopper, where they fall under the force of gravity, into a coin sorting mechanism. The coin sorting mechanism classifies the coins by their diameter. Coins of a particular diameter, and consequently of a particular denomination, are directed into the appropriate one of a plurality of sorted coin storage containers.

One deficiency with known coin sorting devices is their lack of sufficient sorted coin storage space. Known devices utilize only a single coin storage container for each coin denomination. The coin storage containers are typically cylindrical or tubular in shape and are generally of a size corresponding to standard coin rolling wrappers that hold anywhere from twenty to fifty coins. Therefore, with known devices, the operation of the apparatus must be frequently interrupted (if possible) such that the coins in the coin storage containers can be removed before an overflow occurs. Merely lengthening the tubular coin containers to increase the capacity thereof results in a coin sorting apparatus that is too tall for convenient use and storage. Also, conventional coin wrappers are not generally usable with coin cylinders or tubes that are significantly longer than the coin wrappers themselves.

Another drawback of the known coin sorting devices is the lack of any safety switch mechanism to prevent activation of the coin separating mechanism when the sorted coin containers are not operatively positioned to receive the sorted coins. Thus, with known devices, the potential exists for the activation of the coin separating mechanism even when the sorted coin containers are not operatively positioned to receive the sorted coins. This results in the spillage of coins from the coin sorting mechanism onto the floor, table, or other area adjacent the apparatus.

While known coin sorting devices do include mechanisms for pivoting the sorted coin containers between an operative position and a container removal position, these known mechanisms do not include means for releasably securing the containers in either position. Consequently, with known devices, it is possible to accidentally pivot the coin containers out of their operative position while the coin separating mechanism continues to operate thereby spilling coins. It is also possible to pivot the coin containers out of their removal position to some intermediate position. Unwanted movement of the coin container assembly in this manner makes it difficult for a user to remove the containers from the apparatus without spilling coins. Unwanted movement of the coin container assembly from its operative position can result in the spillage of coins from the individual containers.

Accordingly, it is desirable to develop a new and improved coin sorting apparatus which would overcome the foregoing deficiencies and others while providing better and more advantageous overall results.

SUMMARY OF THE INVENTION

According to the present invention, a new and improved coin sorting apparatus is provided.

In accordance with a first aspect of the present invention, the coin sorting apparatus includes a coin hopper. A coin ramp slopes downwardly from an upper end to a lower end and includes a plurality of differently sized apertures formed therethrough. The apertures are arranged such that only coins less than a particular size pass through each aperture. A coin container assembly includes a plurality of coin containers for receiving sorted coins. The container assembly moves between an operative position and a coin container removal position. A coin separator mechanism dispenses coins from the hopper onto the ramp. A switch selectively disables the coin separator mechanism when the coin container assembly is pivoted out of its operative position.

In accordance with another aspect of the present invention, the coin sorting apparatus includes a coin hopper. A coin ramp slopes downwardly from an upper end to a lower end. The coin ramp includes a plurality of differently sized apertures formed therethrough. Each aperture respectively allows the passage of coins having a diameter less than a particular value. A coin container assembly includes at least a first and a second set of coin containers. Each set includes a plurality of coin containers, wherein the containers of the second set are positioned relative to the containers of the first set such that upon one of the containers of the first set being filled with coins, additional coins conveyed from the ramp to the filled container slide over the filled container and into a corresponding container of the second set. A coin separator mechanism dispenses coins from the coin hopper onto the ramp.

In accordance with still another aspect of the present invention, the coin sorting apparatus includes a housing and a coin receiving area defined in the housing. A coin ramp is inclined downwardly from an upper region to a lower region an includes a plurality of differently sized apertures formed therethrough. The apertures are sized and arranged such that each aperture allows only the passage of coins less than a particular size. A pivotable coin container assembly includes a plurality of coin containers for receiving sorted coins. The container assembly pivots between at least a first and a second position. A cam and follower mechanism includes a cam and a follower wherein one of the cam and the follower is connected to the container assembly and the other of the cam and the follower is movably connected to the housing such that upon the movement of the latter, the container assembly pivots between its first and second positions. The cam includes first and second dwell points for releasably securing the container in its first and second positions, respectively.

In accordance with yet another aspect of the present invention, the coin separating apparatus includes a coin receiver area. An inclined ramp, including a plurality of coin sorting apertures formed therethrough, is positioned to receive coins from the coin receiver area. A coin chute assembly includes a plurality of downwardly sloping coin chutes positioned respectively beneath the coin sorting apertures of the ramp. Each of the plurality of chutes includes opposed side walls defining an enlarged space therebetween at an upper end of each of the chutes. The side walls converge toward each other to define a coin exit channel at a lower end of each of the plurality of chutes. Each coin exit channel is minimally wide enough to allow the unrestricted passage of the relevant sorted coin therethrough. A plurality of coin containers are positioned respectively beneath the coin chutes to receive coins from the coin exit channels.

One advantage of the present invention is the provision of a new and improved coin sorting apparatus.

Another advantage of the present invention is the provision of a coin sorting apparatus that includes at least two sets of sorted coin containers for increased sorted coin storage.

Still another advantage of the present invention is the provision of a coin sorting apparatus with at least two sets of sorted coin containers wherein coins are automatically directed into the appropriate container of the second set when the corresponding container of the first set becomes filled with coins.

Yet another advantage of the present invention is the provision of a coin sorting apparatus with increased sorted coin storage without an associated increase in height of the apparatus and without eliminating the ability to use conventional coin wrappers within the sorted coin containers.

A further advantage of the present invention is the provision of a coin sorting apparatus with a cam and follower mechanism operable by a user of the apparatus to pivot or otherwise move the coin container assembly between an operative position and a container removal position.

A still further advantage of the present invention is the provision of a coin sorting apparatus with a safety switch to prevent operation of the coin separator mechanism when the sorted coin containers are not operatively positioned.

A yet further advantage of the present invention is the provision of a coin sorting apparatus with sorted coin containers that move between an operative position and a removal position, and including means for releasably securing the coin containers in their operative and storage positions, respectively.

Another advantage of the present invention is the provision of a coin sorting apparatus with a stiffened coin sorting plate to prevent the sorting plate from flexing during coin separating operation.

A still further advantage of the present invention is the provision of a coin sorting apparatus with a coin chute assembly wherein each chute includes side walls that converge toward each other such that coins pass freely into each chute and are accurately channeled to the appropriate sorted coin container.

Still other benefits and advantages of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein:

FIG. 14A is a top plan view of a coin separator wheel or plate in accordance with the present invention;

FIG. 14B is a cross-sectional view along line A—A of FIG. 14A;

FIG. 14C is a partial side elevational view showing an alternative embodiment of the coin separator plate; and, FIG. 15 is a partial top plan view illustrating an alternative arrangement for the sorted coin storage containers.

DETAILED DESCRIPTION OF THE PREFERRED EMBODIMENTS

Figure 1:
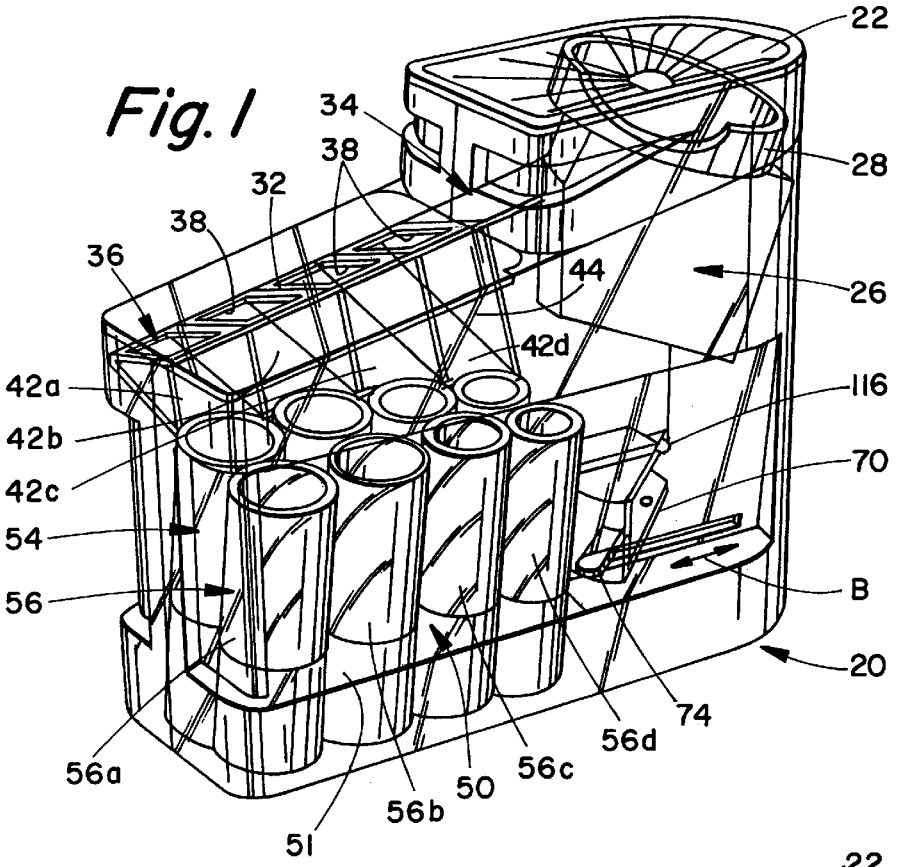
FIG. 1 is a perspective view of a coin sorting apparatus in accordance with a first preferred embodiment of the present invention.

Referring now to the drawings, wherein the showings are for purposes of illustrating preferred embodiments of the invention only and not for purposes of limiting the same, FIGS. 1–9 show a coin sorting apparatus in accordance with a first preferred embodiment of the present invention. The apparatus includes a housing 20 made from plastic or a similar conventional material. As shown herein, the housing 20 is preferably made from a transparent plastic such that the operation of the apparatus can be easily viewed by an operator or a bystander. An exploded view of the housing 20, showing the individual components thereof, is provided in FIG. 8. In FIGS. 1–5, 7, and 8, the electromechanical portions of the coin separator mechanism, and its associated safety switch, are omitted for clarity.

Figure 4:
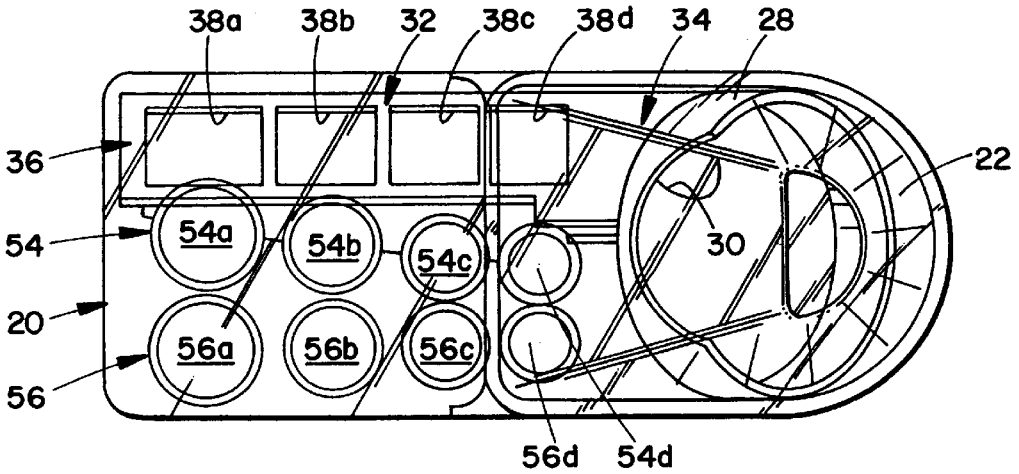
FIG. 4 is a top plan view of the apparatus shown in FIG. 1.

With reference now to FIG. 1, the housing 20 generally includes a coin funnel 22 which communicates coins deposited by a user into a hollow coin receiving area or hopper 24 (FIG. 2) defined within the housing 20. The housing 20 also includes a coin separator mechanism enclosure 26 which houses the electromechanical components of the coin separator mechanism discussed below. The coin separator enclosure 26 includes an enlarged coin tray portion 28 that defines the lower extent of the coin hopper 24. With reference now to FIG. 4, the coin tray 28 includes a coin exit aperture 30 formed therethrough in an upper portion to provide an exit for the coins deposited into the hopper 24. The aperture 30 is formed in an upper portion of the tray 28 to prevent the unrestricted flow of coins therethrough upon the coins being deposited into the hopper 24.

A coin slide or ramp 32 has an upper end 34 positioned adjacent the coin exit aperture 30 such that coins exiting the coin hopper 24 through the aperture 30 are deposited directly onto the ramp 32. The ramp slopes downward from the upper end 34 toward a lower end 36 (see FIG. 3) such that coins slide downward from the upper end 34 toward the lower end 36. The ramp 32 is made from plastic or another material having a sufficiently low coefficient of friction to allow the coins to slide thereon. Furthermore, the ramp 32 has a slope that is neither too steep nor too gentle such that coins deposited thereon slide in a smooth and uninterrupted fashion, but yet to fast. Also, although the ramp 32 as shown herein conveys the coins in a generally linear or straight path, it should be recognized that the ramp 32 may alternatively be provided in a curved configuration to convey coins along a non-linear path such as a helical path.

The coin ramp 32 includes a plurality of differently sized apertures formed therethrough. The number of apertures formed through the ramp 32 preferably corresponds to the number of differently sized coins in common circulation for the currency of a particular country. Thus, for sorting coins of the United States of America, for example, the ramp 32 preferably includes four differently sized apertures 38*a*–38*d* corresponding to the quarter, nickel, penny and dime, respectively, as shown herein. The apertures 38*a–d*, which may be of any suitable geometric shape, are sized such that only coins smaller than a particular diameter will pass therethrough.

By arranging the apertures 38*a–d* in order of increasing size from the upper portion 34 of the ramp 32 to the lower portion 36 of the ramp 32, the largest coins being sorted will pass over all of the apertures 38*b–d*, as these are too small to allow the passage of the largest coins therethrough. The largest coins will therefore pass through the aperture 38*a*. All of the smaller coins will fall through the appropriate one of the upstream apertures 38*b–d*. In particular, upon sliding down the ramp 32 each coin will pass through the first aperture 38*a–d* encountered which is sufficiently large to allow the passage of the coin therethrough. In this manner, the coin sorting apparatus of the present invention sorts the coins of a particular monetary system in terms of their diameter.

Figure 8:
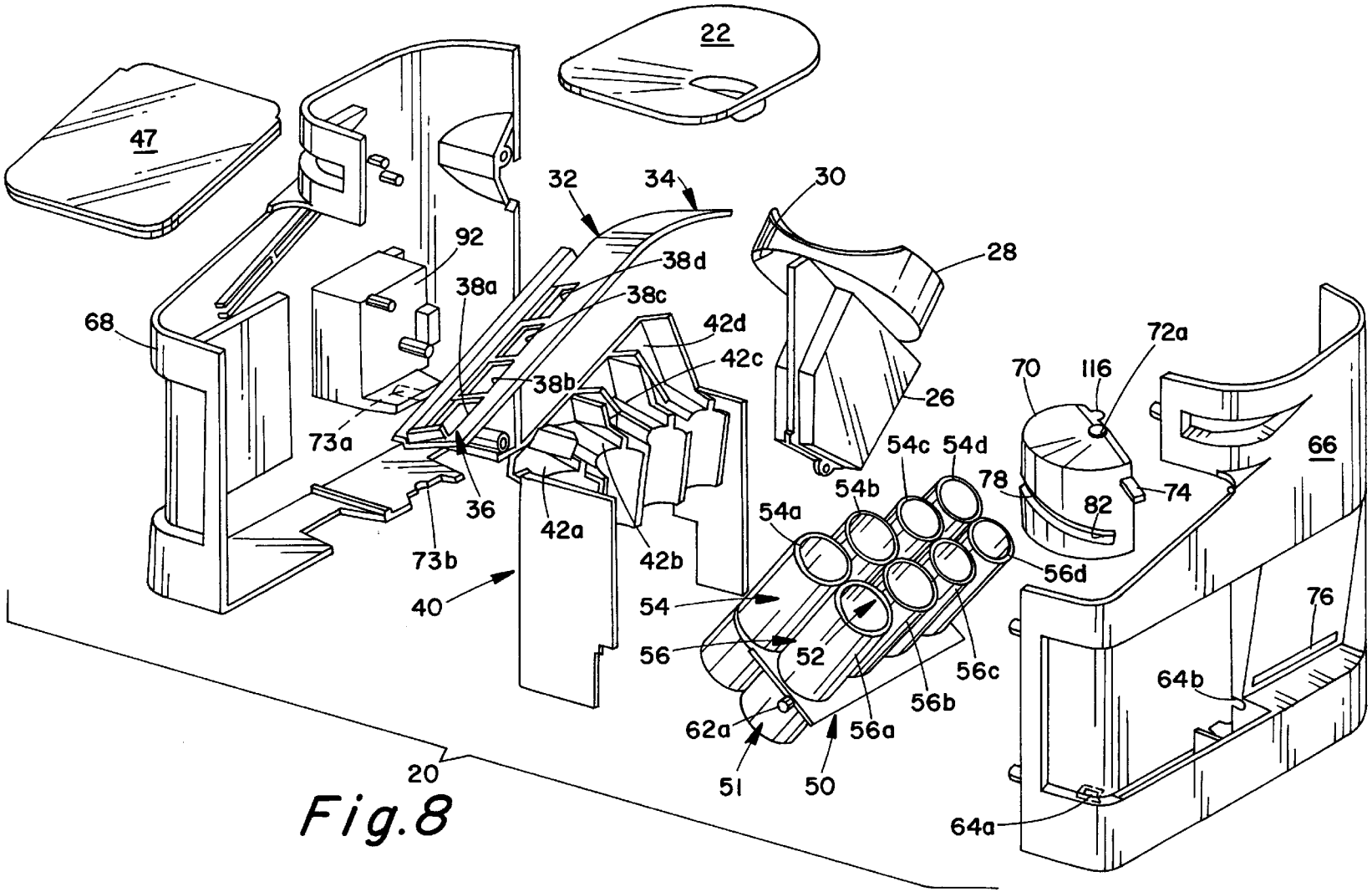
FIG. 8 is an exploded perspective view of the apparatus shown in FIG. 1.

With particular reference now to FIG. 8, the housing 20 also includes a coin chute assembly 40 having a plurality of coin chutes 42*a*–42*d*. Each coin chute 42*a–d* has a minimum width that is preferably only slightly larger than the diameter of the appropriate coin in order to accommodate its passage. As is seen most clearly in FIG. 11 wherein the coin chute 42*a* is shown as an example, each coin chute 42*a–d* preferably includes an upper shield or baffle 44 positioned to prevent coins from bouncing out of their respective chutes 42*a–d*. With reference again to FIGS. 2 and 8, the housing 20 also includes a removable cover 47 that allows hand access to the ramp 32 and the coin chute assembly 40 as needed.

Figure 13:
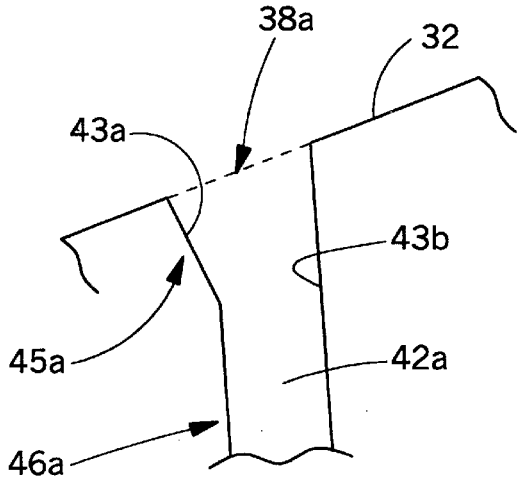
FIG. 13 shows the preferred structure for the coin chutes of the coin chute assembly.

With reference to FIG. 13, the preferred arrangement for the coin chute assembly 40 and the plurality of coin chutes 42*a–d* is shown with exemplary reference to the chute 42*a*. Each chute 42*a–d* includes first and second side walls 43*a*, 43*b* that converge toward each other from an upper region 45*a–d* of each chute 42*a–d* to a lower region 46*a–d* of each chute 42*a–d*, respectively. The side walls 43*a*, 43*b* thus act to channel coins from the enlarged upper region 45*a–d* of each chute 42*a–d* into the relatively constricted lower region 46*a–d* of each chute 42*a–d*. The upper region 45*a–d* of each chute 42*a–d* receives coins from the aperture 38*a–d*, respectively. Enlarging the chutes 42*a–d* at their upper regions 45*a–d* allows the coins from the apertures 38*a–d* to pass freely into the chutes 42*a–d*. At the lower region 46*a–d*, however, the walls 43*a*, 43*b* are minimally spaced from each other but still allow the unobstructed passage of the appropriate coin therebetween. Positioning the walls 43*a*, 43*b* of each chute 42*a–d* such that they converge from the upper end 45*a–d* to the lower end 46*a–d* as described ensures that coins will be accurately funneled into the appropriate one of the coin containers 52.

With continuing reference to FIG. 8, the housing 20 also includes a sorted coin container assembly 50. The coin container assembly 50 includes a base 51 that slidably receives a plurality of sorted coin storage containers in a releasable fashion. Preferably, as shown herein, the sorted coin containers are provided in the form of hollow cylindrical tubes 52 which are open at their upper ends and closed at their lower ends. Each tube 52 has a diameter that is sufficiently large to accommodate the diameter of the sorted coins to be stored therein. However, the diameter of each tube 52 is preferably small enough such that the coins deposited therein stack into a column formation rather than an arbitrary shape.

Figure 5:
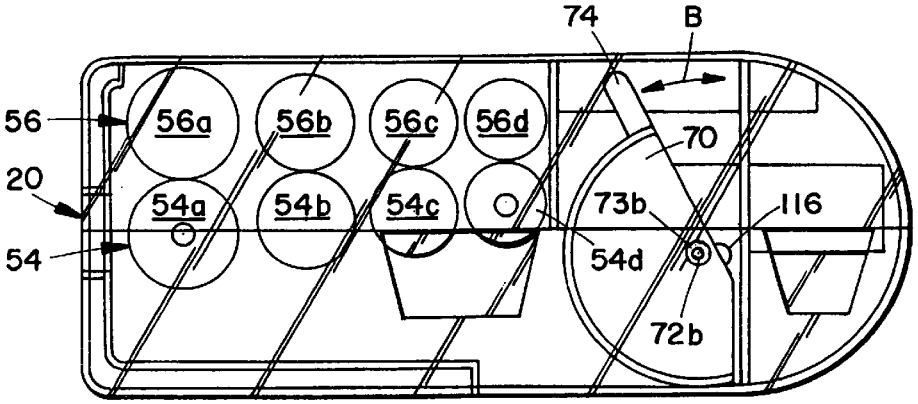
FIG. 5 is a bottom plan view of the apparatus shown in FIG. 1.

Preferably, a particular size tube 52 is provided for each diameter of coin being sorted. As shown in FIG. 5, the coin storage tube assembly 50 comprises at least a first set 54 of tubes 52 including tubes 54*a*–54*d* of the appropriate diameter to receive the United States quarter, nickel, penny and dime, respectively. Preferably, the coin storage tube assembly 50 also comprises a second set 56 of tubes 52 including tubes 56*a*–56*d*. The tubes 54*a–d* and 56*a–d* are aligned respectively with one another. Each tube 54*a–d*, 56*a–d* is also aligned respectively with the appropriate coin chute 42*a–d* as is evident from FIG. 4. The tubes 54*a–d* are respectively interchangeable with the tubes 56*a–d*.

Figure 12:
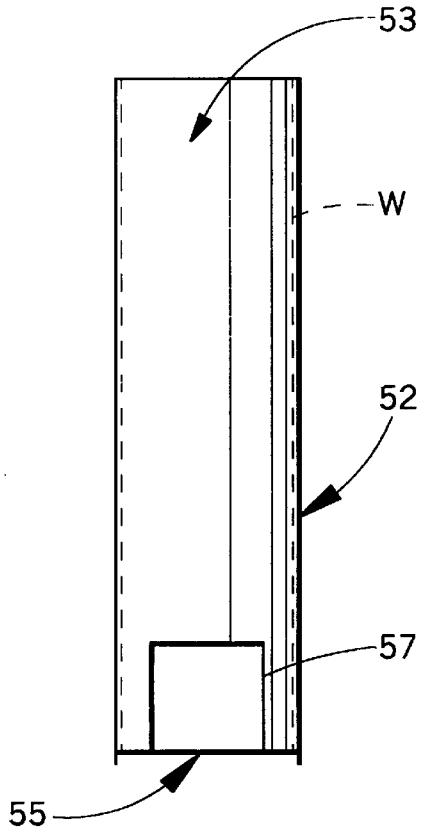
FIG. 12 is a side elevational view of a sorted coin container in accordance with the present invention.

FIG. 12 shows a preferred configuration for the containers 52 wherein the container 52 receives a coin wrapper W in which to package the sorted coins. Each container 52 includes an open upper end 53 to receive coins from the chute assembly 40 and a closed lower end 55. Each container 52 includes a projection 57 extending upward from the lower end 55 thereof into the container 52. This projection 57 is provided to ensure that there is sufficient unfilled space in the wrapper W such that the ends thereof can be folded or otherwise restricted to maintain the coins in the wrapper W. Also, it can be seen that the upper edge of the coin wrapper W is maintained below the upper end 53 of the container 52 so that it will not interfere with the passage of coins into the container 52.

Figure 2:
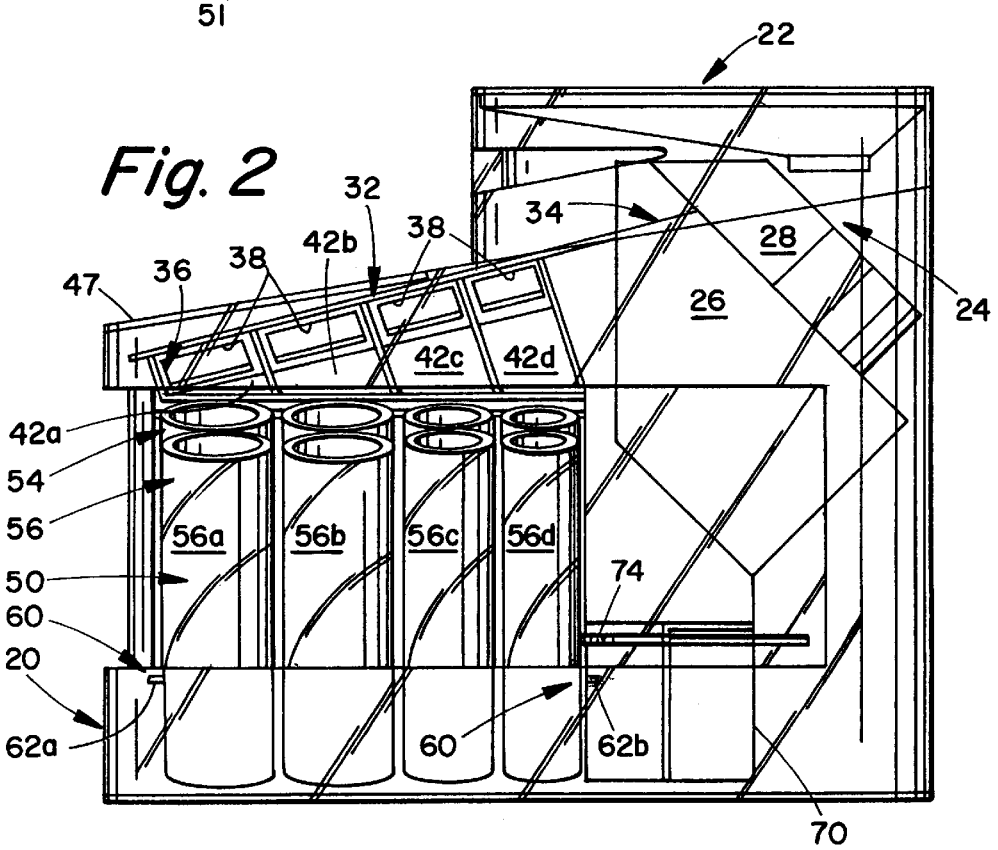
FIG. 2 is a front elevational view of the apparatus shown in FIG. 1.
Figure 3:
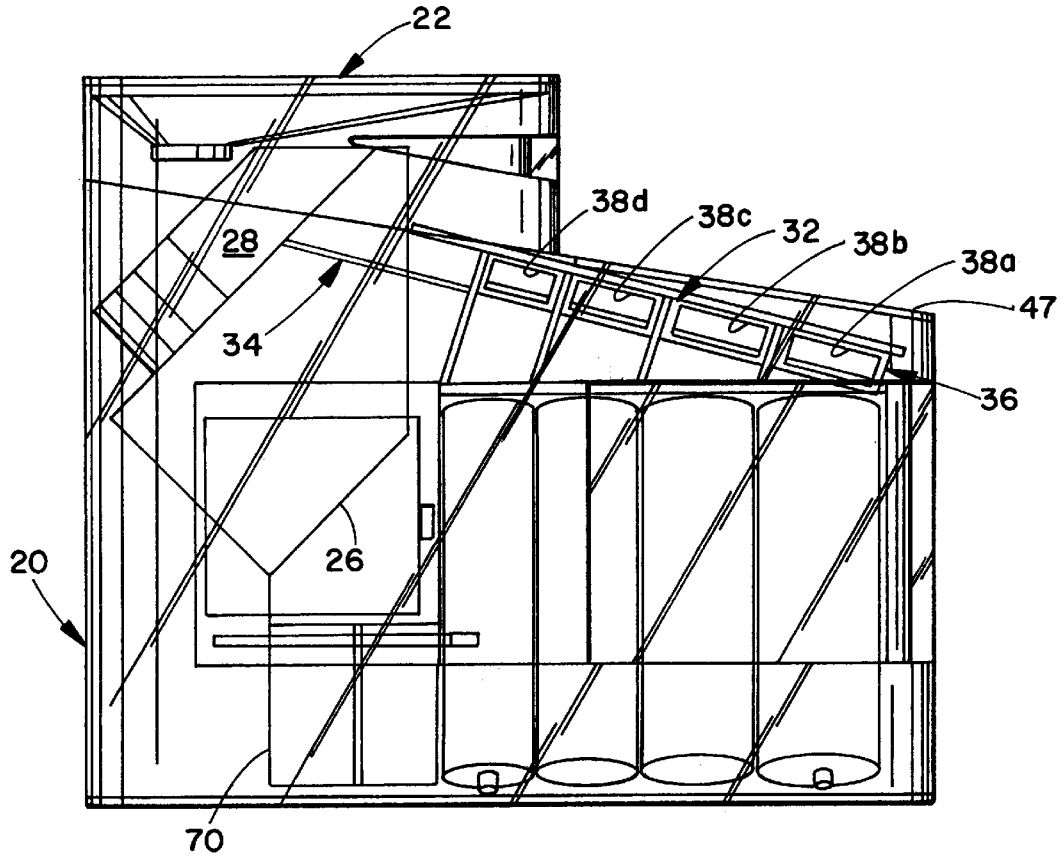
FIG. 3 is a rear elevational view of the apparatus shown in FIG. 1.

With reference to FIGS. 1 and 2, the first set 54 of containers 52 is positioned adjacent the coin chute assembly 40 such that coins from the chute assembly 40 are deposited into the appropriate tube 54*a–d*. As is seen most clearly with additional reference to FIG. 11, each coin storage container 56*a–d* of the second set 56 is preferably positioned immediately adjacent the corresponding container 54*a–d* of the first set 54. With reference to the tubes 54*a*,56*a* shown in FIG. 11 as an example, upon one of the containers 54*a–d* becoming filled to capacity with coins C, any additional coins C' conveyed down the coin chute assembly 40 will slide over the top of the filled coin storage container 54*a–d* and be deposited into the corresponding coin storage container 56*a–d* of the set 56. This automatic transfer from a container 54*a–d* to a corresponding container 56*a–d* is facilitated by positioning each container 56*a–d* in the container assembly base 51 such that the upper end 53 of each container 56*a–d* is lower than the upper end 53 of each container 54*a–d*, respectively. Furthermore, the containers 54*a–d*,56*a–d* are preferably tilted relative to vertical such that coins C,C' more easily slide into the containers 54*a–d*, 56*a–d*. Tilting the containers 54*a–d*,56*a–d* also facilitates the sliding movement of coins C' over the filled containers 54*a–d*. Preferably, the containers 54*a–d*,56*a–d* are tilted sufficiently such that their upper edges 53 have a slope that corresponds to the slope of the coin chutes 42*a–d*, respectively.

Figure 11:
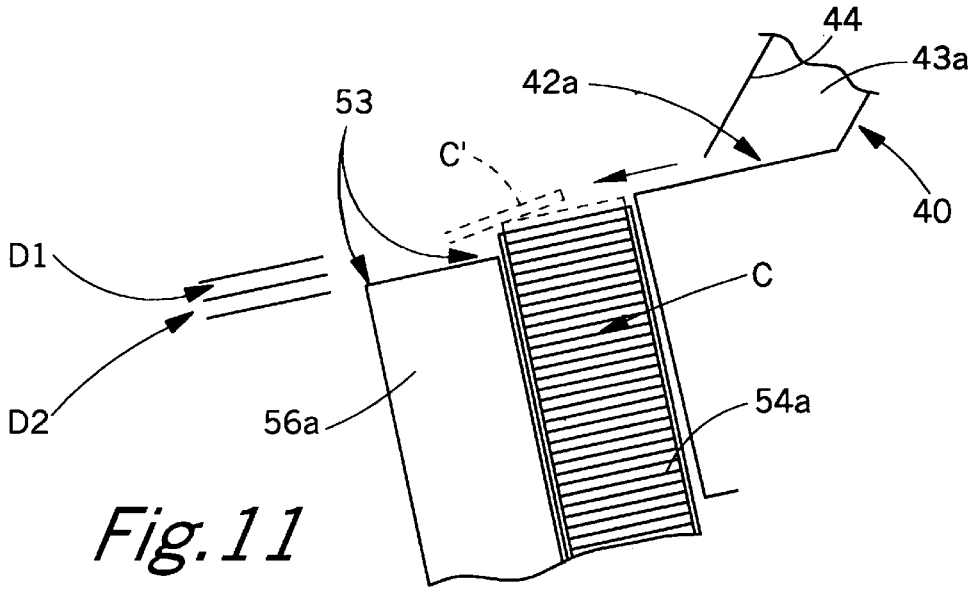
FIG. 11 is a partial side elevational view illustrating a preferred arrangement of the sorted coin storage containers.

With continuing reference to FIG. 11, it can be seen that the container 54*a* is positioned such that its upper end 53 is lower than the coin chute 42*a* by a distance D1. Likewise, the container 56*a* is positioned such that its upper end 53 is lower than the upper end 53 of the container 54*a* by a distance D2. The distance differentials D1,D2 may be the same or different. A distance differential D1,D2 prevents coins C,C' from becoming lodged against the upper end 53 of the containers 54*a*,56*a*. Of course, while FIG. 11 shows only containers 54*a*,56*a*, the foregoing discussion applies equally to all of the containers 54*a–d*,56*a–d*. Because the tubes 54*a–d* are respectively interchangeable with the tubes 56*a–d*, the coin container assembly base 51 is configured to establish the distance differentials D1 and D2. Specifically, the containers 54*a–d* are received in the base 51 a select distance to establish the differential D1. The containers 56*a–d* are more deeply received within the base 51 than the containers 54*a–d* by an amount equal to the distance D2.

FIG. 15 shows an alternative arrangement of the sorted coin containers 52 with particular reference to the coin storage containers 54*a*,56*a*. Rather than being positioned closely adjacent one another, the containers 54*a*,56*a* are separated by an intermediate ramp member 58 that conveys the overflow coins C' from the container 54*a* to the container 56*a*. The ramp member 58 is therefore positioned at an elevation that is lower than the upper edge 53 of the containers 54*a–d* but higher than the upper edge 53 of the containers 56*a–d* to prevent coins from becoming lodged against the ramp member 58 and against the containers 56*a–d*. As with FIG. 11, the arrangement shown in FIG. 12 is suitable for all of the containers 54*a–d*, 56*a–d*.

Figure 6A:
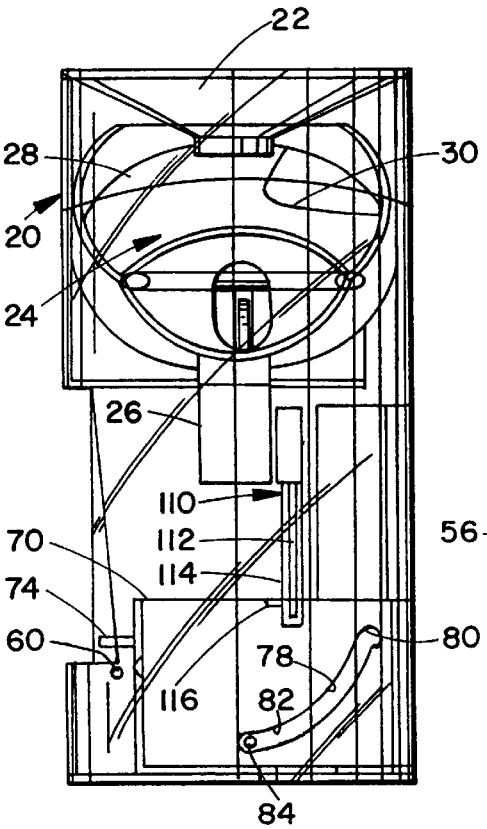
FIG. 6A is a right side elevational view of the apparatus shown in FIG. 1, with the container assembly in its operative position.
Figure 6B:
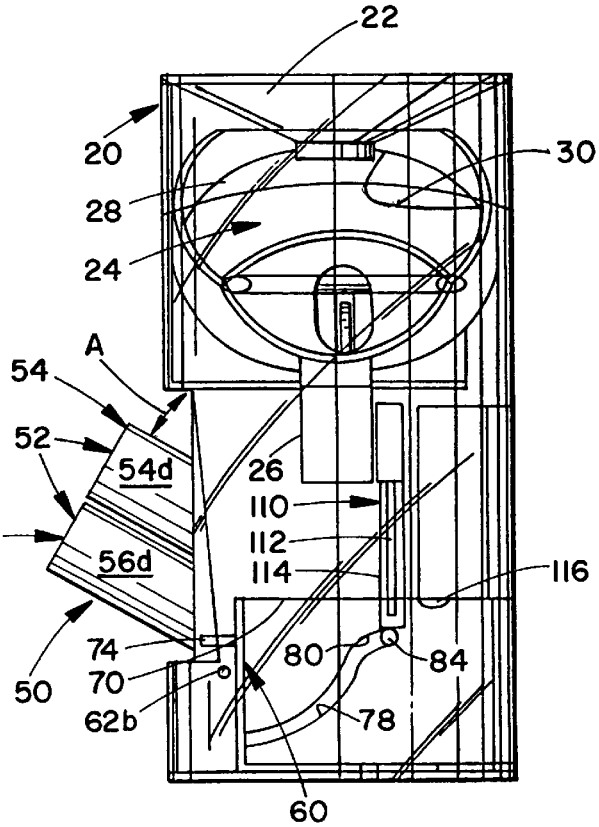
FIG. 6B is a right side elevational view of the apparatus shown in FIG. 1, with the container assembly in its container removal position.

As is seen most clearly in FIGS. 6A and 6B, the sorted coin container assembly 50 is pivotally or otherwise movably connected to the remainder of the housing 20 using a hinge assembly 60, a sliding track, or like means. The hinge assembly 60 allows the container assembly 50 to pivot between an operative position (FIGS. 1 and 6A) and a tube removal position (FIG. 6B) as is shown by the arrow A in FIG. 6B. FIGS. 2 and 8 most clearly show a suitable means to provide the hinge assembly 60. The base 51 of the container assembly 50 includes first and second pins 62*a*, 62*b* projecting from opposite lateral sides thereof. The pins 62*a*,62*b* are received respectively within grooves 64*a*,64*b* defined in a front half 66 of the housing 20. Alternatively, the container assembly 50 may slide or otherwise move between the operative and container removal positions.

As shown in FIG. 8, the housing 20 includes the front half 66 and a rear half 68 which are joined together by conventional means such as adhesive and/or mechanical fasteners. Supported in the housing 20 is a rotatable cam 70 that controls the position of the container assembly 50. With particular reference to FIGS. 5 and 8, it can be seen that the cam 70 is generally semi-cylindrical in shape. Upper and lower pins 72*a*,72*b* or similar means are provided for pivotally connecting the cam 70 to the housing 20. The rear half 68 of the housing 20 includes first and second vertically spaced grooves or apertures 73*a*,73*b* (FIG. 8) to receive the pins 72*a*,72*b* of the cam 70, respectively. Projecting from the cam 70 is a lever 74 by which an operator of the coin sorting apparatus rotates the cam 70 to control the pivotable position of the coin storage tube assembly 50.

As is shown in FIG. 1, the lever 74 of the cam 70 extends through a slot 76 formed in the front half 66 of the housing 20. An operator of the coin sorting apparatus can move the lever 74 along the slot 76 as indicated by the arrow B, thereby rotating the cam 70 around a vertical axis defined by the pins 72*a*,72*b*. With reference to FIGS. 6A and 6B, it can be seen that the cam 70 also includes a cam slot 78 formed therein. The cam slot 78 includes a first or upper dwell point 80 and a second or lower dwell point 82. The upper dwell point 80 is formed in the cam slot 78 by forming a notch or the like in the slot 78. The lower dwell point 82 is preferably formed by making the walls of the cam slot 78 parallel to each other and parallel to horizontal.

With continuing reference to FIGS. 6A and 6B, a cam follower pin 84 is connected to and extends from the base 51 of the container assembly 50 into the cam slot 78. The cam follower 84 rides within the cam slot 78 between the upper and lower dwell points 80,82. Those skilled in the art will recognize that movement of the cam lever 74 by a user within the slot 76 causes rotation of the cam 70 relative to the remainder of the housing 20. Upon rotation of the cam 70, the relative position of the cam slot 78 and the follower 84 changes. This change in relative position between the follower 84 and the cam slot 78 causes the container assembly 50 to pivot as shown by the arrow A in FIG. 6B. Those skilled in the art will also recognize that the cam 70 may alternatively be provided as a part of the container assembly 50 with the follower 84 being movably connected to the housing 20 for selective movement by an operator.

As the upper dwell point 80 of the cam slot 78 moves into engagement with the follower pin 84, the container assembly 50 pivots into a container removal position (FIG. 6B) wherein the operator can easily remove the sorted coin storage containers 52 from the base 51. Once the user moves the lever 74 to the container removal position, the dwell point 80 inhibits unwanted movement of the follower pin 84 in the cam slot 78 to releasably secure the container assembly 50 in the container removal position. Likewise, as the user operates the lever 74 to bring the lower dwell point 82 of the cam slot 78 into engagement with the follower pin 84 (FIG. 6A), the container assembly 50 pivots inward to its operative position (FIGS. 1, 6A) wherein the sorted coin storage containers 52 are properly aligned with and positioned adjacent the coin chute assembly 40 to receive coins. The engagement of the follower pin 84 and the lower dwell point 82 releasably secures the container assembly 50 into its operative position such that it does not accidentally pivot away from the coin chute assembly 40 as might otherwise occur under the weight of the coins deposited into the tubes 52 or upon the accidental jarring of the sorting apparatus. Therefore the cooperation between the dwell points 80,82 and the follower pin 84 ensures that the sorted coin container assembly 50 will only pivot as shown by the arrow B when an operator purposely moves the lever 74.

Figure 7:
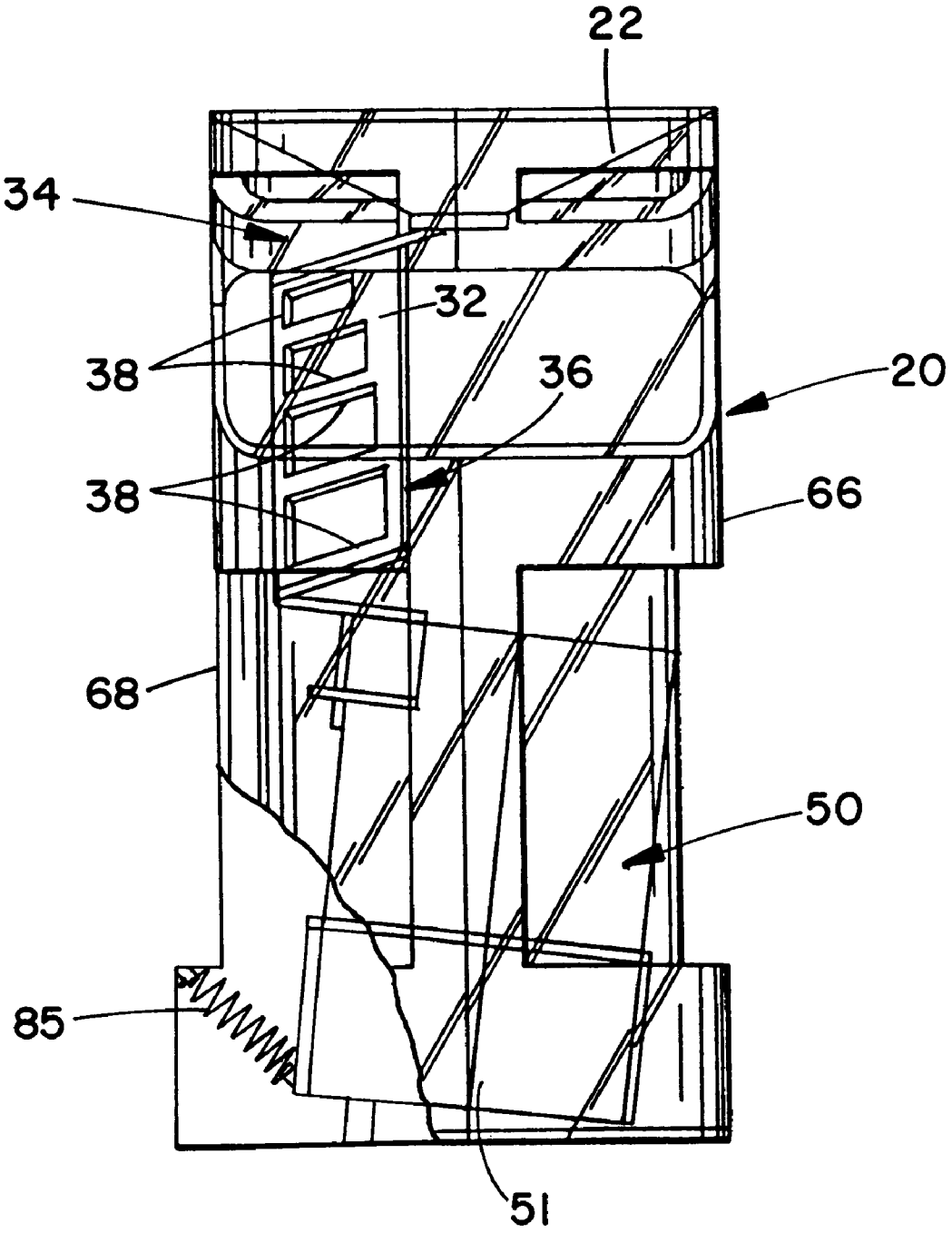
FIG. 7 is a left side elevational view, with a portion broken away, of the apparatus shown in FIG. 1.

If desired, the coin sorting apparatus could include means for biasing the container assembly 50 into the operative position. For example, as is shown in FIG. 7, a suitable conventional tension spring 85 could be connected between a tab located on the rear half 68 of the housing 20 and another tab located on the base 51 of the container assembly 50. The biasing means also acts as a shock absorber to dampen the movement of the container assembly 50 during its movement to the container removal position. This dampening is especially helpful when the containers 52 are weighted with coins C.

Figure 9:
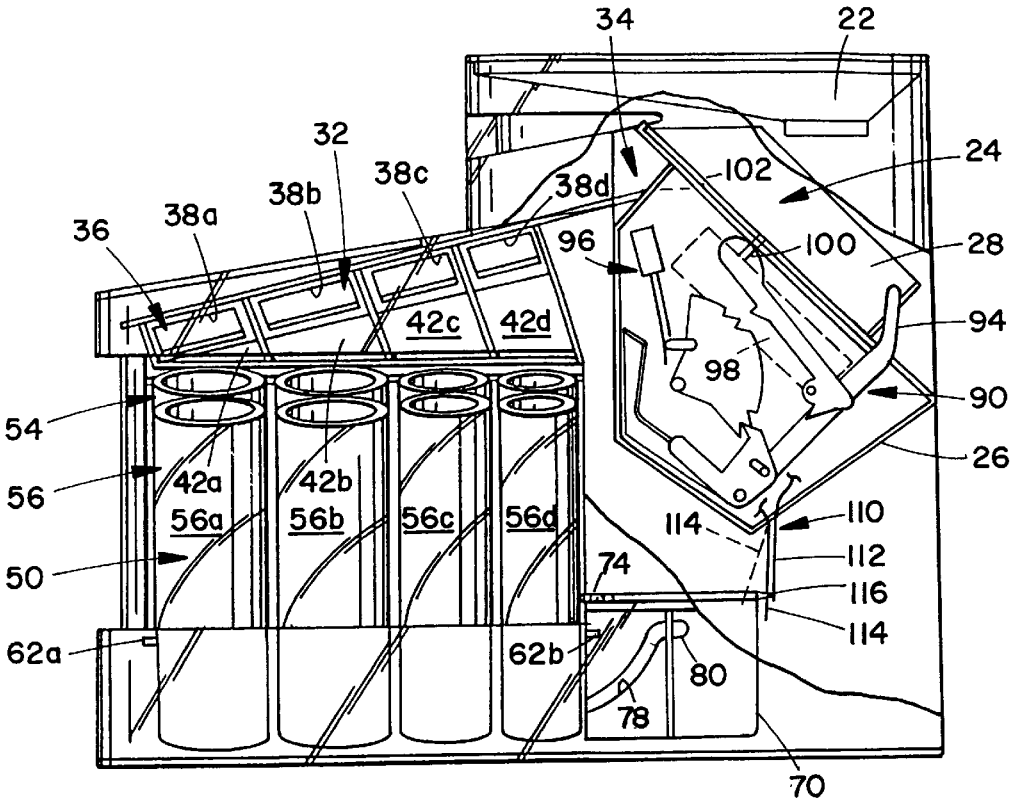
FIG. 9 is a front elevational view of the apparatus shown in FIG. 1, with a portion broken away to reveal the coin separator mechanism and the associated safety switch.
Figure 10:
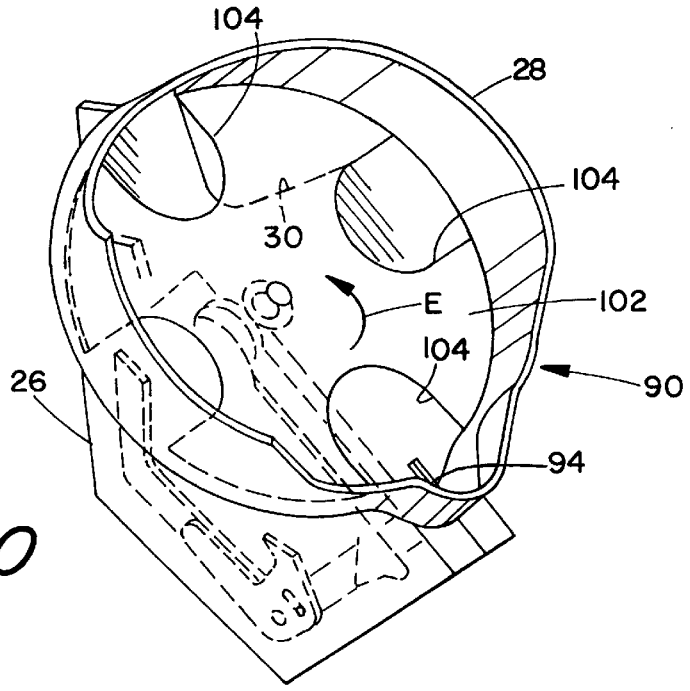
FIG. 10 is a perspective view of the coin separator mechanism of the apparatus of FIG. 9 and its enclosure.

Referring now particularly to FIGS. 9 and 10, the coin separating mechanism of the coin sorting apparatus is shown generally at 90. The general construction and operation of the coin separating echanism 90 is described in U.S. Pat. No. 5,474,496 issued Dec. 12, 1995 and assigned to the assignee of the present application, said patent being expressly incorporated in its entirety by reference herein. The coin separating mechanism 90 is housed within the enclosure 26 of the housing 20. The housing 20 also includes a battery enclosure 92 (FIG. 8) defined in the rear half 68 to contain one or more batteries that provide electrical power to the coin separating mechanism 90.

As coins are dropped into the coin hopper 24, a lever 94 of the coin separating mechanism 90 is depressed under the weight of the coins. Upon the depression of the lever 94, a switch 96 is closed to energize a motor 98. The motor 98 includes a shaft 100 that is drivingly connected to a rotatable coin separator plate 102 positioned in the coin tray portion 28 of the enclosure 26. The coin separator plate 102 includes a central aperture 103 (FIG. 14B) to receive the drive shaft 100 of the motor 98. The motor 98 rotates the coin separator plate 102 counterclockwise as indicated by the arrow E. The separator plate 102 includes a plurality of U-shaped notches 104 formed therein. Coins in the hopper 24 are individually received within a U-shaped notch 104 and are conveyed to the exit aperture 30.

As the U-shaped notch 104 of the separator plate 102 passes over the exit aperture 30, the coin located in the notch 104 falls through the aperture 30 onto the ramp 32. The coin slides down the ramp 32 and through the appropriate one of the plurality of apertures 38*a–d*. Each notch 104 accommodates even the largest diameter coin being sorted. However, the notches 104 are also appropriately sized such that no more than one coin is received therein at any one time. Also, the coin separator plate 102 is thinner than the thinnest coin being sorted to prevent coins from stacking in a notch 104. Upon the last coin being emptied from the coin hopper 24, the switch 96 opens—as the lever 94 is gravity-biased or spring-biased back to its normal position—and the motor 98 is stopped.

Referring now particularly to FIGS. 14A and 14B, the preferred structure of the coin separator plate 102 can be seen. Specifically, the coin separator plate 102 is manufactured from conventional plastic. However, the thinness of the plate 102, as required to prevent more than one coin from being received within each notch 104, can result in the plate 102 being too flexible. This undesirable flexibility allows coins to slip beneath the plate 102, between the plate 102 and the coin tray 28 of the housing 20. Thus, the plate 102 preferably includes means to increase its stiffness such as at least one radially extending reinforcement rib 106. The ribs 106 are preferably positioned beneath a domed central portion 107 of the plate 102. While the domed central portion 107 serves to stiffen the plate 102 in conjunction with the ribs 106, the domed portion 107 also serves to direct coins radially outward toward the notches 104.

FIG. 14C shows an alternative structure for the coin separator plate 102' which does not need to include the ribs and the domed central portion. The plate 102' is relatively thicker than the plate 102 for increased rigidity. However, to prevent coins C",C'" from stacking in the U-shaped notches 104', each notch 104' includes a trailing edge 105 (the edge that pushes the coins C" to the coin exit aperture 30) that tapers down to the necessary thinness such that only one coin C" is received in each notch 104'. The inclined or tapered trailing edge 105 also encourages any additional coins C'" stacked atop the first coin C" to slide up on top of the plate 102' and into another open notch 104'.

FIGS. 6A, 6B, and 9 most clearly show the safety switch 110 of the coin sorting apparatus. The safety switch 110 prevents the spillage of coins that would otherwise result upon activation of the coin separating mechanism 90 without the container assembly 50 being properly operatively positioned. The safety switch 110 selectively disables the coin separator mechanism 90 when the coin container assembly 50 is not in its operative position with the coin containers 52 properly located to receive coins from the coin chute assembly 40.

The safety switch 110 includes first and second electrical contacts 112,114. As is shown in phantom in FIG. 9, the safety switch 110 is normally open to interrupt the flow of electrical power to the motor 98. When the safety switch 110 is open, the coin separating mechanism 90 cannot be activated by the presence of coins in the coin hopper 24. Therefore, the coin sorting apparatus also includes means for selectively closing the safety switch 110 when the container assembly 50 is operatively positioned to allow the operation of the coin separating mechanism 90.

One suitable means for closing the switch 110 is shown in FIGS. 1 and 9. Such means can comprise a projection 116 located on the cam 70 for urging the second contact 114 of the switch 110 against the first contact 112 when the cam 70 is rotated to a position where the coin tube assembly 50 is operatively 30 positioned. When a user operates the cam lever 74 to move the container assembly 50 to the container removal position (FIG. 6B) the projection 116 is pivoted away from the contact 114, allowing its separation from the contact 112. Those skilled in the art will recognize that a wide variety of switch means exist for selectively interrupting the operation of the coin separating mechanism 90 and for determining whether or not the coin tube assembly 50 is in its proper operative position. The present invention is not meant to be limited to the particular arrangement shown herein.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

Having thus described the preferred embodiments, the invention is now claimed to be:

1. A coin sorting apparatus comprising:

a coin hopper;

a coin ramp sloping downwardly from an upper end to a lower end and including a plurality of differently sized apertures formed therethrough, said apertures being arranged such that only coins less than a particular size pass through each aperture;

a coin container assembly including a plurality of coin containers for receiving sorted coins, said container assembly pivotable between an operative position and a coin container removal position;

a coin separator mechanism for dispensing coins from said hopper onto said ramp;

a switch for selectively disabling said coin separator mechanism when said coin container assembly is pivoted out of said operative position; and, a rotatable cam engaged with said coin container assembly such that a rotation of said cam pivots said coin container assembly between its operative and container removal positions.

2. The coin sorting apparatus as set forth in claim 1, wherein said coin container assembly includes a cam follower extending therefrom, said cam follower cooperating with said cam to pivot said container assembly, wherein said cam comprises first and second dwell points for releasably securing said follower, said container assembly being releasably secured in said container removal position when said cam follower is releasably engaged by said first dwell point and said container assembly being secured in said operative position when said cam follower is releasably engaged by said second dwell point.

3. The coin sorting apparatus as set forth in claim 2, wherein said cam comprises a slot, wherein said cam follower is slidably engaged in said slot, and wherein said first and second dwell points are located along said slot.

4. The coin sorting apparatus as set forth in claim 3, wherein said first and second dwell points are located at opposite ends of said slot.

5. The coin sorting apparatus as set forth in claim 1 wherein said rotatable cam comprises a lever extending therefrom by which an operator of said coin sorting apparatus rotates said cam.

6. The coin sorting apparatus as set forth in claim 1, wherein said cam acts upon said switch to close said switch and enable said coin separator mechanism when said coin container assembly is in its operative position.

7. A coin sorting apparatus comprising:

a coin hopper;

a coin ramp sloping downwardly from an upper end to a lower end and including a plurality of differently sized apertures formed therethrough, each aperture respectively allowing the passage of coins having a diameter less than a particular value;

a coin container assembly pivotally movable between the operative and container removal positions comprising at least first and second sets of coin containers, each of said sets of coin containers including a plurality of coin containers, wherein said containers of said second set are respectively positioned adjacent said containers of said first set such that upon one of said containers of said first set being filled with coins, additional coins from said ramp slide over said filled one of said containers of said first set into a corresponding adjacent container of said second set;

a coin chute assembly including a plurality of coin chutes for respectively conveying coins that Pass through said plurality of apertures of said coin ramp to said first and second sets of containers;

a rotatable cam acting upon said container assembly such that rotation of said cam pivots said container assembly between said operative and said container removal positions;

a coin separator mechanism for dispensing coins from said coin hopper onto said ramp, said coin separator mechanism including a motor and a coin separator plate operatively connected to and driven by an output shaft of said motor, said coin separator plate including a plurality of peripheral coin receiving notches, each of said plurality of notches including an inclined trailing edge inhibiting stacking of multiple coins in said notch, whereby, upon rotation of said coin separator plate in response to activation of said motor, coins in said coins hopper are received in said plurality of peripheral notches and are individually carried to and deposited on an upper portion of said coin ramp; and, a switch for selectively disabling said coin separator mechanism when said container assembly is moved out of said operative position.

8. The coin sorting apparatus as set forth in claim 7, wherein said plurality of containers of said second set are separated from said plurality of containers of said first set, and further comprising a ramp connecting an upper portion of each of said containers of said first set to an upper portion of a corresponding container of said second set.

9. The coin sorting apparatus as set forth in claim 7, wherein said coin separator plate includes at least one reinforcement rib to stiffen said plate.

10. The coin sorting apparatus as set forth in claim 7, further comprising:

a follower cooperatively engaged with said cam and connected to said container assembly such that said container assembly pivots in response to rotation of said cam.

11. The coin sorting apparatus as set forth in claim 7, further comprising:

a follower cooperatively engaged with said rotatable cam and extending from said container assembly such that said container assembly pivots in response to rotation of said cam.

12. A coin sorting apparatus comprising:

a housing;

a coin receiving area defined in said housing;

a downwardly inclined coin ramp including a plurality of differently sized apertures formed therethrough, said apertures sized and arranged such that each aperture allows only the passage of coins less than a particular size;

a pivotable coin container assembly comprising a plurality of coin containers for receiving sorted coins, said container assembly being pivotable between at least a first and a second position; and, a cam and follower mechanism comprising a cam and a follower wherein one of said cam and follower is connected to said container assembly and the other of said cam and follower is movably connected to said housing such that upon the movement of said other of said cam and follower, the container assembly pivots between said first and second positions, said cam including first and second dwell points for releasably securing said container in said first and second positions, respectively.

13. A coin sorting apparatus as set forth in claim 12, wherein said follower is connected to and extends from said container assembly and wherein said cam is rotatably connected to said housing.

14. A coin sorting apparatus comprising:

a coin receiver area;

an inclined ramp positioned to receive coins from said coin receiver area and including a plurality of coin sorting apertures formed therethrough;

a coin chute assembly including a plurality of downwardly sloping coin chutes positioned respectively beneath said coin sorting apertures of said ramp, said plurality of chutes each comprising opposed side walls defining a coin exit channel at a lower end of each of said chutes, said coin exit channel being wide enough to allow the unrestricted passage of these relevant sorted coin therethrough;

at least two substantially similar coin containers positioned respectively beneath each of said plurality of coin chutes to receive and retain in a stack coins from said coin exit channels, wherein said at least two coin containers positioned beneath each of said chutes are so located that coins from said coin chute assembly first fill a first one of said at least two containers through an open upper end thereof and thereafter fill a second one of said at lease two containers through an open upper end thereof; and, means for removably mounting each coin container on the coin sorting apparatus.

15. The coin sorting apparatus as set forth in claim 14, wherein said coin containers are movable as a unit between an operative position for receipt of coins from said coin chute assembly and a container removal position for individual removal of each of said coin containers from said coin sorting apparatus.

16. The coin sorting apparatus as set forth in claim 15, wherein said coin sorting apparatus further comprises a cam and follower mechanism operable by a user of said apparatus to pivot said plurality of coin containers as a unit between the operative and container removal positions.

17. The coin sorting apparatus as set forth in claim 15, wherein said coin receiver area is provided by a coin hopper, said coin sorting apparatus further comprising:

an electromechanical coin separator mechanism for dispensing coins from said hopper onto an upper portion of said ramp; and, a safety switch to prevent operation of said electromechanical coin separating mechanism when said plurality of coin containers are not in the operative position.

18. The coin sorting apparatus as set forth in claim 15, further comprising means for biasing said plurality of coin containers into the operative position.

19. The coin sorting apparatus as set forth in claim 18, wherein said biasing means dampens the movement of said plurality of coin containers between the operative and container removal positions.

20. A coin sorting apparatus comprising:

a coin receiver area;

an inclined ramp positioned to receive coins from said coin receiver area and including a plurality of coin sorting apertures formed therethrough;

a coin chute assembly including a plurality of downwardly sloping coin chutes positioned respectively beneath said coin sorting apertures of said ramp, said plurality of chutes each comprising opposed side walls defining a coin exit channel wide enough to allow the passage of the relevant sorted coin therethrough;

a plurality of coin containers removably positioned in a first row respectively beneath said plurality of coin chutes to receive coins from said coin exit channels;

a plurality of coin containers removably positioned in a second row located adjacent the containers of the first row;

means for removably mounting each coin container of said first and second rows of coin containers on the coin sorting apparatus; and, means for delivering coins from said coin chute assembly to a container in said second row of containers when an adjacent container in said first row of containers is filled.

21. A coin sorting apparatus comprising:

a coin hopper to receive a plurality of coins;

a downwardly sloping ramp including an upper end, a lower end, and a plurality of apertures formed therethrough in order of increasing size toward said ramp lower end;

a coin separator mechanism for dispensing individual coins from said coin hopper onto an upper part of said ramp;

a coin chute assembly including a plurality of sloped coin chutes positioned respectively beneath said plurality of apertures formed in said ramp such that a coin passed through one of said apertures is communicated to a corresponding one of said coin chutes;

a first set of sorted coin containers, each of said sorted coin containers of said first set positioned adjacent a lower end of one of said coin chutes such that coins are communicated from said coin chutes into an open upper end of said sorted coin containers, respectively; and, a second set of sorted coin containers substantially similar to said first set, each of said sorted coin containers of said second set positioned adjacent a respective like one of said sorted coin containers of said first set, such that an open upper end of each of said sorted coin containers of said second set receives coins from one of said coin chutes when said adjacent container of said first set is filled to capacity with coins, wherein said sorted coin containers of said first and second sets are tilted relative to a vertical axis to facilitate sliding movement of coins over filled containers of said first set and into adjacent containers of said second set.

22. The coin sorting apparatus as set forth in claim 21 wherein said first and second sets of sorted coin containers are removably received in a coin container assembly base and wherein said base is selectively movable between an operative position where said sorted coin containers are located to receive coin from said coin chute assembly, and an inoperative sorted coin container removal position for individual insertion and removal of each of said containers from said base.

23. The coin sorting apparatus as set forth in claim 21 wherein said sorted coin containers of said first and second sets are tilted at an angle such that upper edges of said containers defining the open upper container ends are sloped at approximately the same angle as said sloped coin chutes.

24. The coin sorting apparatus as set forth in claim 21 further comprising:

a coin separator mechanism activating switch located in said coin hopper and acted upon by coins loaded into said hopper to activate said coin sorter mechanism while coins are present in said hopper.

25. The coin sorting apparatus of claim 21 wherein said open upper end of each sorted coin container of said second set of coin containers is positioned at a lower elevation than is said open upper end of said adjacent sorted coin container of said first set of coin containers.

26. A method of sorting coins of four different diameters, said method comprising:

conveying unsorted coins of said four different diameters under force of gravity on a sloped surface;

passing coins of each of said four different diameters through four different diameter apertures formed through said sloped surface and onto four different sloped coin chutes, respectively;

passing coins from said four different coin chutes respectively into an open upper end of four different diameter coin containers of a first set of coin containers when said containers of said first set are not filled to capacity with coins; and, passing coins from said four different coin is chutes respectively into an open upper end of four different diameter containers of a second set of coin containers when said containers of said first set are filled to capacity with coins, said four different coin containers of said first and second sets respectively the same size and shape;

moving said first and second sets of containers together relative to said coin chutes from a first position for receiving coins from said coin chutes to a second position; and, individually separating each of the containers from the other containers and inverting each container to empty coins from the open upper end thereof.

* * * * *